United States Patent [19]

Raney

[11] Patent Number: 4,690,229

[45] Date of Patent: Sep. 1, 1987

[54] RADIALLY STABILIZED DRILL BIT

[76] Inventor: Richard C. Raney, 3609 Godfrey Ct., Midland, Tex. 79707

[21] Appl. No.: 820,742

[22] Filed: Jan. 22, 1986

[51] Int. Cl.[4] ..... E21B 10/60; E21B 17/10

[52] U.S. Cl. ..... 175/325; 175/393; 175/408

[58] Field of Search ..... 175/393, 399, 408, 230, 175/228, 337, 325

[56] References Cited

U.S. PATENT DOCUMENTS

| | | | |
|---|---|---|---|
| 712,887 | 11/1902 | Wyczynski | 175/398 |
| 2,857,141 | 10/1958 | Carpenter | 175/393 |
| 3,062,303 | 11/1962 | Schultz | 175/61 |
| 3,123,162 | 3/1964 | Rowley | 175/325 |
| 3,225,843 | 12/1965 | Ortloff et al. | 175/230 |
| 3,512,592 | 5/1970 | Kellner | 175/230 |
| 4,022,287 | 5/1977 | Lundstrom et al. | 175/393 |
| 4,190,123 | 2/1980 | Roddy | 175/325 |
| 4,253,533 | 3/1981 | Baker | 175/329 |
| 4,351,402 | 9/1982 | Gonzalez | 175/408 |

*Primary Examiner*—Stephen J. Novosad
*Assistant Examiner*—Terry Lee Melius
*Attorney, Agent, or Firm*—Marcus L. Bates

[57] ABSTRACT

A stabilized drill bit has a cylindrical main body, a formation cutting face at the lower end of the body, and means by which the upper end of the bit can be connected into a drill string. A drilling fluid flow passageway extends axially through the main body and provides flow of drilling fluid to the drilling face. A plurality of hydraulic actuated stabilizing members are arranged circumferentially about the throat and within the main body. Stabilizing members have a borehole wall engaging face thereon which can be retracted flush with the outer surface of the main body, and extended away from the main body face and into contact with the borehole wall, thereby stabilizing the drill bit as the bit is rotated while making hole. Hydraulic means is connected to the stabilizing members by which the members are progressively extended toward the borehole wall as the members become worn, and which normally prevents retraction of the stabilizing members so long as drilling fluid pressure is effected within the passageway. The stabilizing members are retracted when the drilling fluid is reduced to a predetermined value.

18 Claims, 15 Drawing Figures

RADIALLY STABILIZED DRILL BIT

BACKGROUND OF THE INVENTION

The present invention pertains to an improved drill bit for forming boreholes as in drilling oil and gas wells. Moore particularly, the present invention pertains to drill bits which employ and contain polycrystalline diamond cutting elements, and are usually referred to as "PDC" drill bits.

Many "PDC" drill bits of the prior art experience a destructive whipping action, or radial vibration of the drill bit which randomly occurs during rotary operation due to clearance between the outside of the drill bit and the wall of the borehole. This whipping tendency intensifies in proportion to the hardness or toughness of the formation being drilled and in proportion to the rotational speed of the drill bit, causing impact contact between the cutting elements of the drill bit and the formation material being drilled, which in turn results in fractured, chipped, or displaced cutting elements, thus drastically shortening the operating life of the drill bit and causing the operating life to be inconsistent and unpredictable.

Another problem often found in prior art "PDC" drill bits is erosion which is caused by high velocity drilling fluid acting on the cutting mountings of the cutting elements, on the drill bit face, and on other components of the bit. This shortens the operating life of the drill bit.

Another problem associated with prior art "PDC" drill bits is balling, plugging, or packing of cut material onto the face of the drill bit due to uneven or unbalanced fluid flow over the face of the drill bit which results in reduced penetration rates and inadequate and uneven cooling of the cutting elements and thereby unpredictably diminish the resultant drilling operation.

Because of the above problems, "PDC" drill bits have heretofore been used economically only in drilling a very limited range of different rock and earth formations. U.S. Pat. Nos. 712,887 (Wyczynski); 2,857,141 (Carpenter); and 3,062,303 (Schultz) each contain radially acting stabilizing means. However, as the respective specifications show, each of those are based on considerably different and less effective principles of operation than the present invention.

SUMMARY OF THE INVENTION

A stabilized drill bit having a main body of general cylindrical configuration and a pin end opposed to a lower drill face. The lower drilling face is of a particular novel configuration and includes cutters thereon for penetrating geological formations when the drill bit is rotated and making hole. A throat is formed longitudinally through the main body for passage of drilling fluid from a drilling string, through the bit, and through the drilling face. The drilling fluid exits the bit and flows across the face in a novel manner.

A plurality of circumferentially arranged bores are formed from the outer surface of the bit into communication with the bit throat. Hydraulically actuated stabilizing members are reciprocatingly received within the bores. Each of the stabilizing members have an outer face which is retracted into alignment with the outer surface of the bit, and which can be extended outwardly from the surface of the bit and into engagement with the wall of a borehole.

Hydraulic means are incorporated into the bit by which each of the stabilizing members are forced to move in a direction outwardly of the main body when the hydrostatic pressure within the throat is greater than the hydrostatic pressure measured at the face of the stabilizing members. The hydraulic means maintains the stabilizing members in the extended configuration, and as the face of the stabilizing member is worn, the member is further extended into engagement with the borehole wall.

The hydraulic means further enables retraction of the stabilizing members respective to the borehole wall surface when the pressure drop across the face of the bit has been equalized.

One object of the present invention is to provide a "PDC" drill bit having a substantially increased operating life with equal or greater drilling penetration rate than prior art "PDC" drill bits and having the capability of drilling more predictably and economically through an extremely wide range of different rock and earth formations.

Another object of this invention is to provide a drill bit having reduced tendency to whip, or radially vibrate, during rotary operation.

Another object of the present invention is to provide an improved drill bit having reduced tendency to ball or plug.

Another and further object of this invention is to provide a "PDC" drill bit that is economical to manufacture.

An additional object of the invention is the provision of a rotary drill bit having retractable stabilizer members arranged about the circumference thereof which can be extended into engagement with the borehole wall while making hole.

Other objects and advantages of the present invention will be apparent upon consideration of the following specification, with reference to the accompanying drawings forming part thereof, and in which like numerals correspond to like parts throughout the several views of the invention.

DETAILED DESCRIPTION OF THE PREFERRED EMBODIMENT

Figure 1:
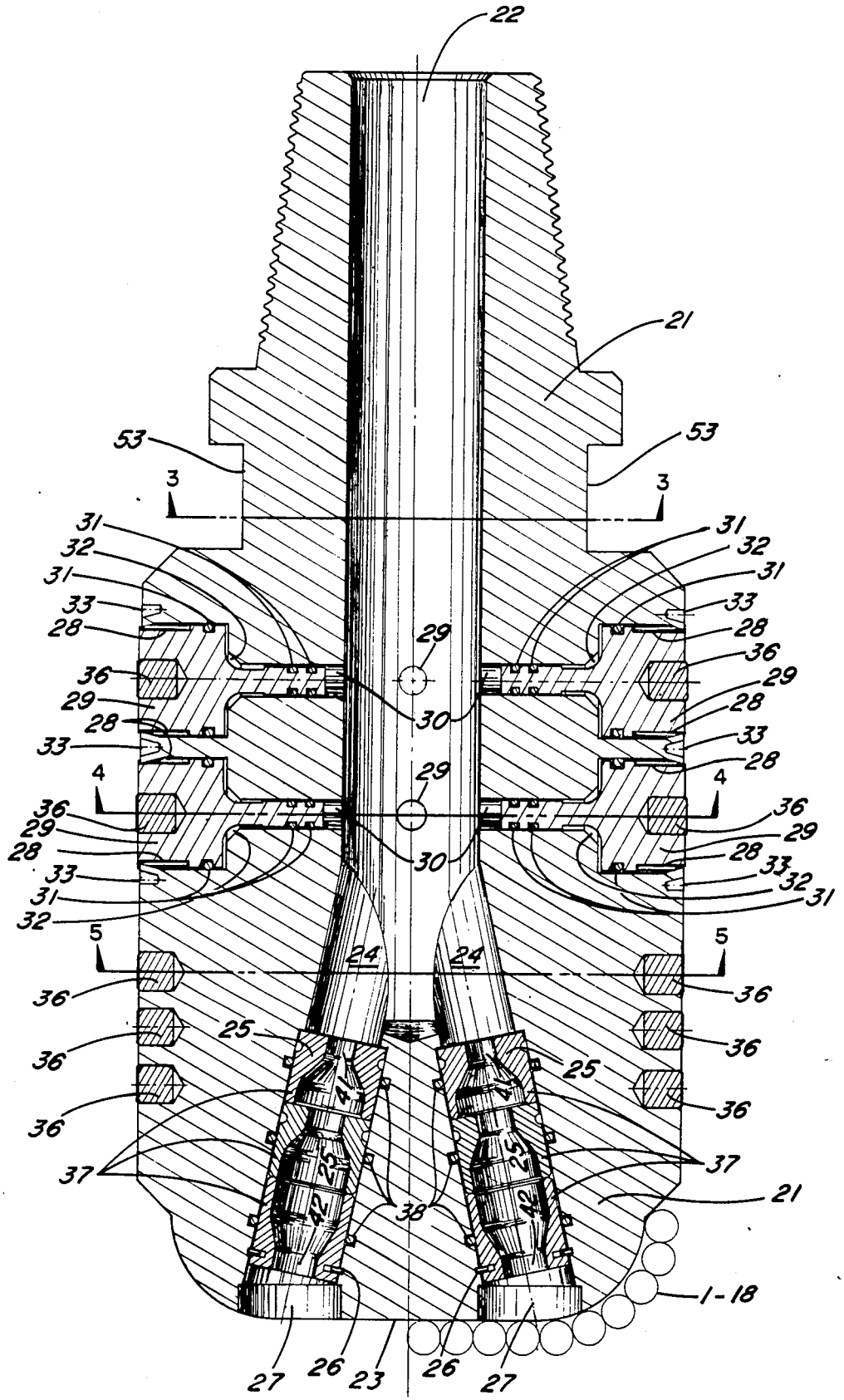
FIG. 1 is a longitudinal, cross-sectional view of the invention.
Figure 9:
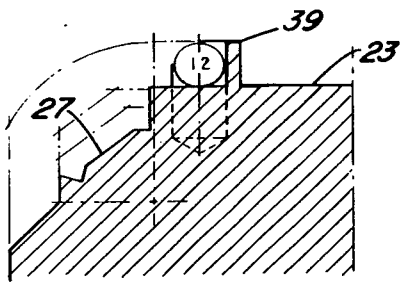
FIGS. 7–14, respectively, are inverted, partial cross-sectional views taken along lines 7–14, respectively, of FIG. 2; and, FIG. 15 is a diagrammatical, part cross-sectional view of a drilling operation with the bit of the present invention being schematically illustrated therewith.
Figure 8:
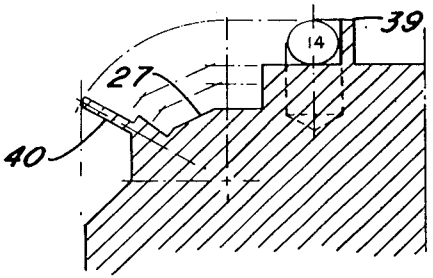
Figure 7:
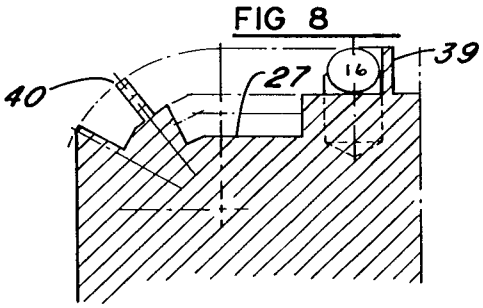

Referring to the figures of the drawings, and in particular FIG. 1, the present invention comprises an improved drilling bit, generally indicated by the numeral 110. The bit has a main body 21 made of a suitable material such as steel. The main body 21 is generally cylindrical in shape and the upper end thereof is threaded in a conventional manner, or is otherwise provided with a known means for attachment to the end of a drill pipe or "drill string". The main body 21 has a central fluid passage or throat 22 extending from the top threaded end, along the central axis towards the lower end or face 23. The lower marginal end of the bit can be an integral part of the bit, as seen in FIG. 1, or it can be a separate member suitably attached to the main body 21.

Figure 2:
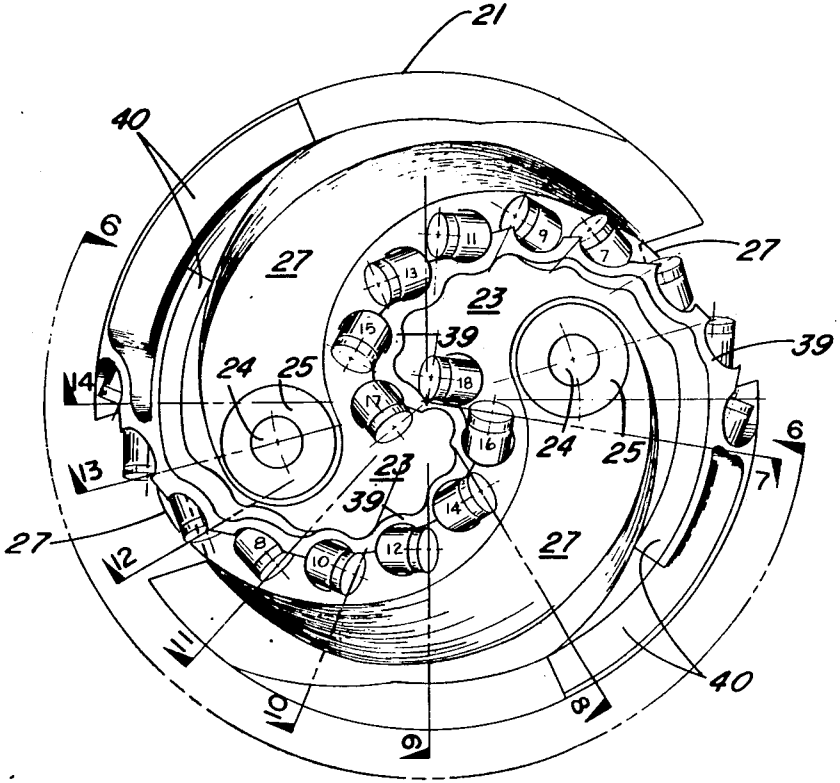
FIG. 2 is a bottom view of the invention of FIG. 1.
Figure 12:
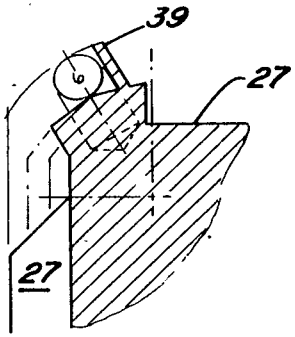
Figure 11:
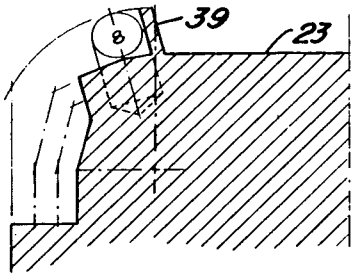
Figure 10:
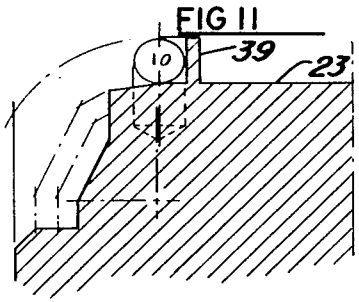

Near the face 23, the throat 22 branches into the illustrated two flow ports 24 which extend from the throat 22 and through the face 23. Flow restrictors 25 are installed in each of the ports 24 and are retained in place by snap rings 26 or other suitable retaining means. Opposed flow slots 27 are machined into the face 23 and into the sides of the main body 21 as more clearly seen in FIGS. 2 and 5. The slots 27 communicate with the two port 24, and as seen in FIGS. 1 and 2, each slot commences at the respective ports 24 and then spirals outward in a direction opposite to the normal rotational direction of the bit. The slots continue along opposite sides of the face 23, then extend up the opposite sides of the main body 21.

In FIGS. 1–2, the bit has mounted thereon a plurality of commercially available polycrystalline diamond cutters such as the illustrated cutting elements 1 through 18. The cutting elements 1–18 preferably are the STRATAPAX (TM) manufactured by The General Electric Company. The cutters are installed in a conventional manner, such as by mounting the cutters on a stud, and pressing the stud into mounting holes formed in the face 23. The cutting elements 1–18 preferably are arranged in two opposite spiral patterns directly behind the flow slots 27, such as illustrated in FIG. 2.

In FIG. 1, the cutters 1–18 are spuriously drawn side by side to show the cutting profile. In actual practice, the cutters 1–18 are each advantageously positioned to cut distinct but overlapping circular paths during the drilling operation, so that a continuous and complete cutting operation is achieved on the bottom of a borehole.

Figure 14:
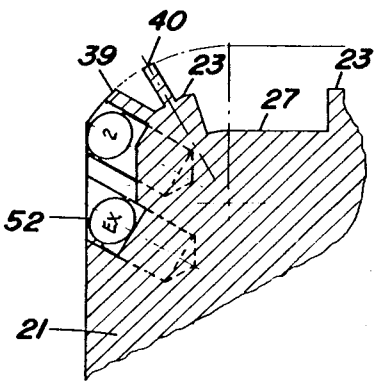
Figure 6:
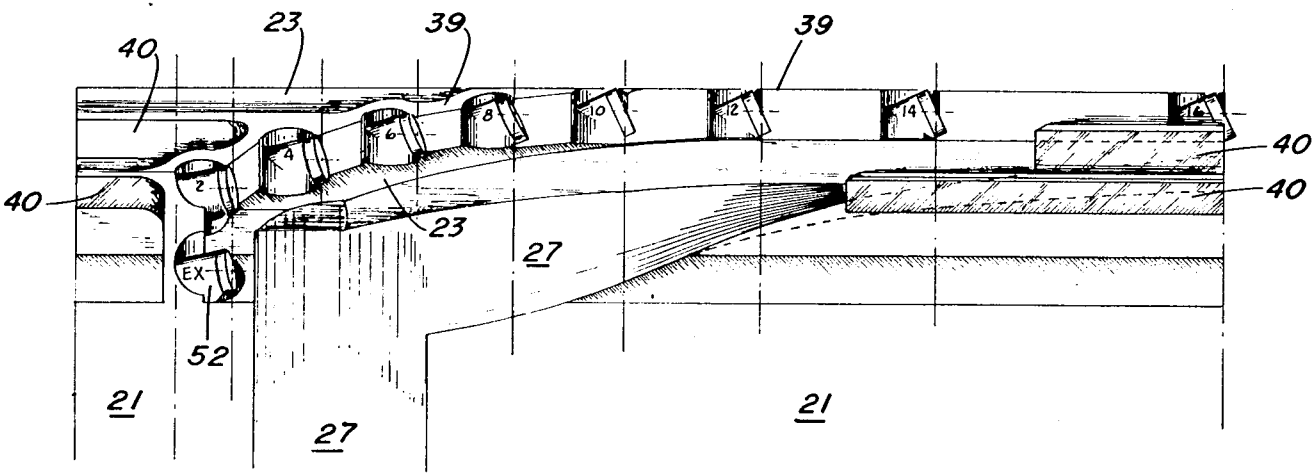
FIG. 6 is a diagrammatical, flattened, inverted, partial side view taken along line 6—6 of FIG. 2 for purposes of simplifying the drawing.

FIGS. 6 and 14 show extra cutters 52 which are added to the periphery of the bit to enhance the ability of the bit to maintain accuracy of the diameter of the borehole. Any number of peripheral or "gauge" cutters 52 may be added as needed. Each of the cutters 1–18 and the gauge cutters 52 are oriented with respect to the main body 21 to engage the formation at the most optimum cutting angle and thereby provide optimum penetration rate of the bit.

The present invention includes a plurality of novel radial stabilizing pistons 29 installed in complementary radial bores 30 formed through the sides and into the main body 21 of the bit 110 to intersect the throat 22. The bores 30 are symetrically arranged about the longitudinal axis of the bit. The pistons 29 are arranged to be positioned as near the face 23 as possible after allowing sufficient space for the other illustrated components therebetween. The preferred embodiment of FIGS. 1–4 show eight such pistons 29, however any suitable number may be employed. The pistons 29 are reciprocated by differential pressure thereacross, with each piston 29 having a small diameter at the inner end thereof and a large diameter at the outer end thereof. The radial bores 30 have corresponding diameters respective to the small end of the pistons 29 facing radially inward towards the center axis of the main body 21 and with the large ends of the pistons 29 facing radially outward. The pistons 29 may be installed directly in the main body 21 as shown, or alternatively may be installed in a separate body (not shown) which is removably attachable to the main body 21. The pistons 29 are slidably sealed to the sides of the radial bores 30 by o-rings 31, or similar means, so that a sealed variable volume chamber 32 is formed between the smaller and larger ends of each piston 29. The chambers 32 increase in volume as the pistons 29 move radially outward and decrease in volume as the pistons 29 move radially inward. The inward travel of the pistons 29 is limited by the larger diameter portion of the pistons 29 abutting against the shoulder formed at the bottom of the larger diameter portion of the bore 30. The outward travel of the pistons 29 is limited by the illustrated shoulder 33'. The pistons 29 are prevented from rotating in the bore 30 by a detent formed by punch impressions 33, or other suitable means, which slidably engage grooves 28 formed along the side of the pistons 29. The grooves 28 extends from the rim of the outer ends of the pistons 29, inwardly along the side of the pistons 29, to a position just short of the outer o-ring seals 31, thus allowing adequate outward travel of the pistons 29, without disrupting any of the seals 31. Each piston 29 may contain one or more grooves 28 as needed.

The outer face of the pistons 29 are provided with wear resistant tungsten carbide buttons 36 pressed into complementary axial holes formed in the face of the pistons 29, so that the wear resistant button 36 is flush or aligned with the outer face of the piston 29, thereby making the outer ends of the pistons 29 wear resistant. The pistons 29 may alternatively be made entirely of a wear resistant material such as ceramic, or may be made wear resistant by other known expedients.

Figure 3:
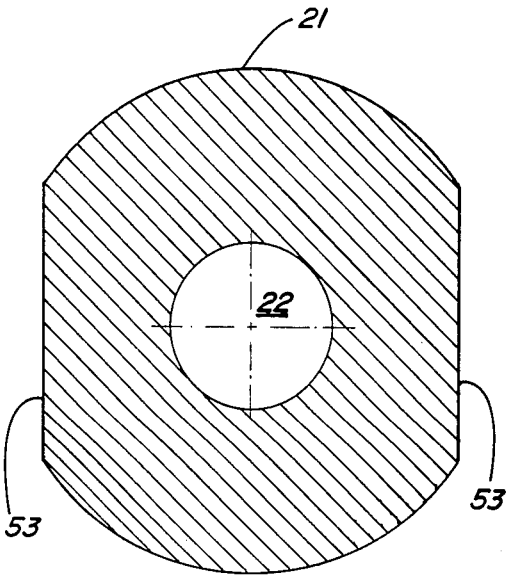
FIG. 3 is a cross-sectional view taken along line 3—3 of FIG. 1.
Figure 4:
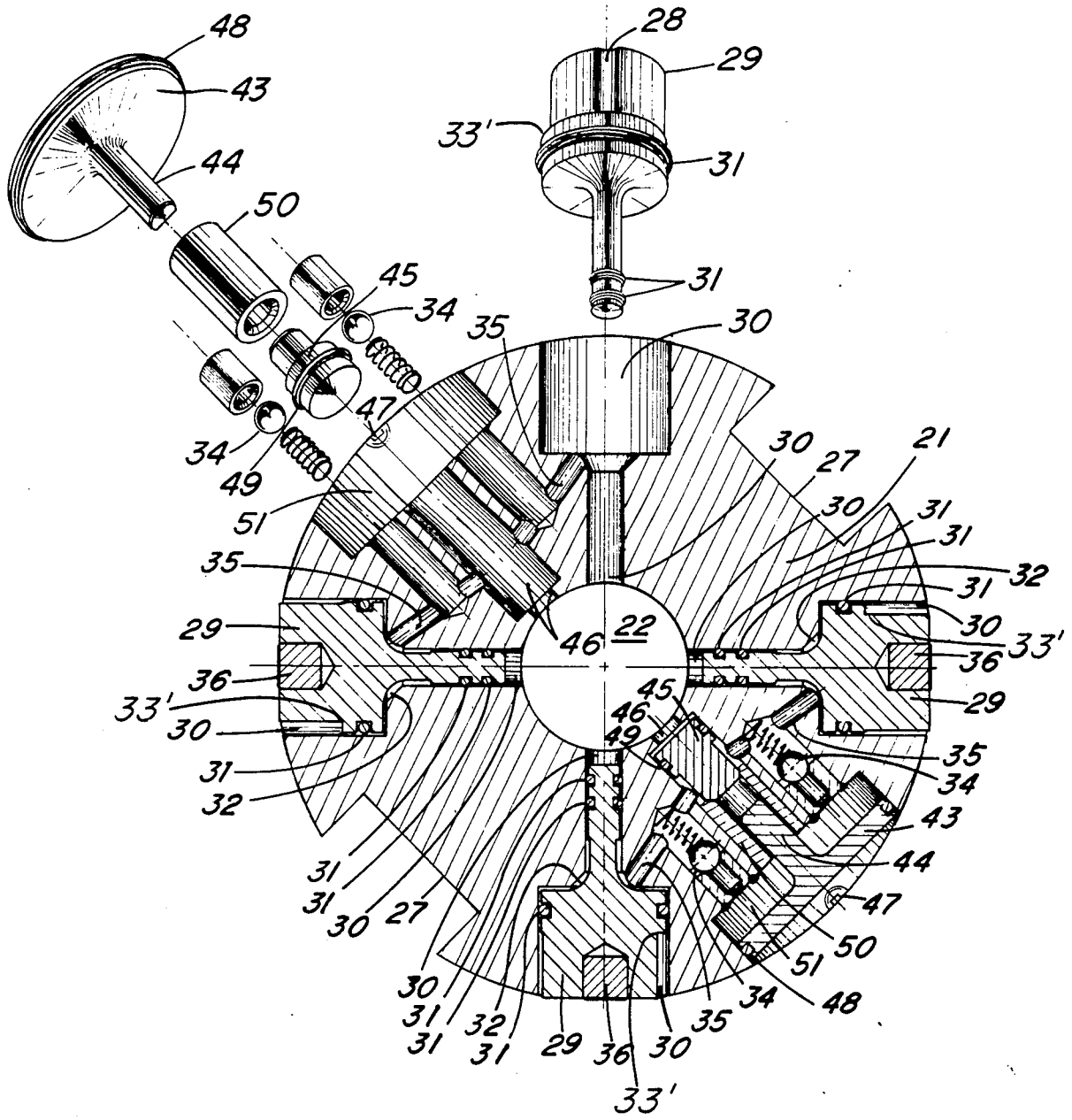
FIG. 4 is a reduced, cross-sectional view taken along line 4—4 of FIG. 1.
Figure 13:
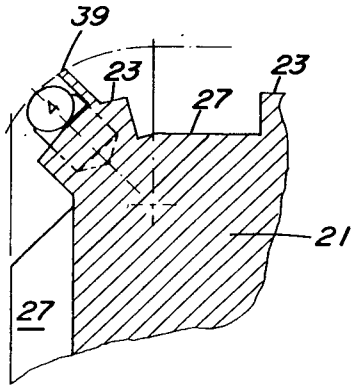

In the cross-sectional illustration of FIG. 4, a check valve 34 is seen to be provided with a corresponding fluid passage 35 for each chamber 32 to allow an incompressible hydraulic fluid, such as viscous oil, to enter but not leave the variable chamber 32. In the embodiment of FIGS. 1–4, a common cylindrical fluid reservoir 51 is provided to pairs of chambers 32 and to respective pairs of check valves 34, with the fluid inlet ends of the check valves 34 being positioned within the reservoir 51. The reservoir 51 is arranged radially respective to the longitudinal central axis of the main body 21. The reservoir 51 is illustrated as being located between pairs of chambers 32 and check valves 34. A small, concentric radial hole 46 extends radially inward into communication with the throat 22, and into communication with the respective passages 35, and provides a means by which a blocking valve assembly 45 can be actuated.

Each radial hole 46 is fitted with one blocking valve 45, which includes a valve element and a mating valve seat formed at one end of a sleeve 50. The blocking valve assembly 45 is arranged to selectively block or freely allow fluid flow into or out of the reservoir 51. The inner end of each blocking valve 45 is reciprocatingly sealed respective to the corresponding radial bore 46 by an o-ring 49, or similar seal means, and is arranged to function as a piston, with the o-ring 49 positioned inward relative to the corresponding pair of passages 35. The outer end of each blocking valve 45 is reduced in diameter respective to the holes 46, to allow fluid to pass from the passage 35 into the hole 46 and vice versa, and includes an end portion which is shaped to be received in sealed relationship against the illustrated valve seat of the sleeve 50. The inward travel of each valve 45 is limited by the illustrated shoulder; however, a snap ring or similar retainer positioned within the inner extremity of each hole 46 can serve as an alternative. The outward travel of each valve 45 is limited by the outer end thereof seating and sealing against the valve seat of the sleeve 50. Each sleeve 50 is fastened and sealed in the illustrated fixed position within each corresponding hole 46, and is positioned to provide the desired contact with respect to the corresponding valve 45. The length and inner bore of the sleeves 50 are sized to accommodate shanks 44 of isolating caps 43 so that the shanks 44 can reciprocate freely in a guided manner within the bore of the sleeves 50.

The isolating caps 43 are received within the bore of the reservoir 51, and are movably sealed in a reciprocating manner therein by o-rings 48, so that hydraulic fluid contained therewithin is isolated from contaminants from without. The caps 43 have the before mentioned rigidly attached shanks 44 which are radially oriented into the sleeves 50 to stabilize the caps 43. The shanks 44 are grooved or flattened to allow fluid to pass through the sleeve 50 into and out of the reservoir 51. The caps 43, with their shanks 44, are arranged to freely move in a stabilized manner as fluid enters or leaves the reservoir 51 to thereby accommodate any change in volume. The radial travel of the caps 43 is sufficient to provide adequate fluid displacement for the corresponding chambers 32. The outward travel of the caps 43 is limited by punch impressions 47 formed on the rim of the reservoirs 51, or by other suitable stop means.

During assembly of the apparatus of the present invention, the chambers 32, check valves 34, passages 35, holes 46, and the reservoir 51 are all filled with a suitable hydraulic fluid, and all gas bubbles are evacuated therefrom so that an incompressible fluid is contained therein. Hydraulic fluid can be filled through resealable drilled holes located in the caps 43, or in the body 21, or the filling could be completed before the caps 43 are installed, or various other filling methods might be utilized in order to achieve this desired result.

Figure 5:
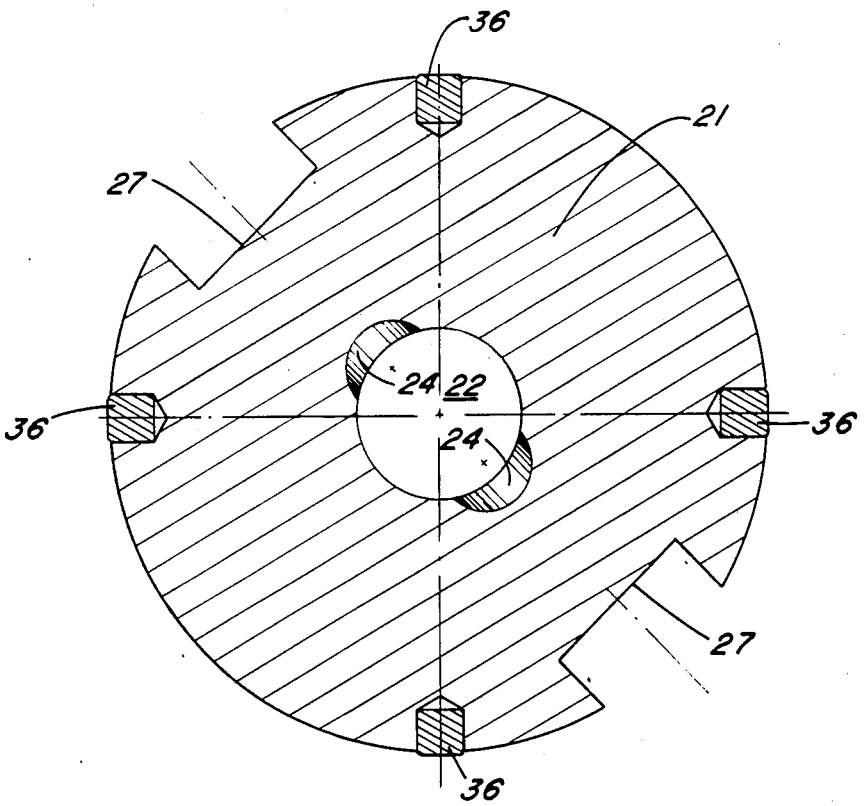
FIG. 5 is a cross-sectional view taken along line 5—5 of FIG. 1.

As best seen illustrated in FIGS. 1 and 5, each of a plurality of additional wear resistant buttons 36 are pressed flush into each of a plurality of radial holes arranged symmetrically around the outer periphery of the lower marginal end of the main body 21 at a location immediately above the face 23. Any other suitable means may be employed to protect the periphery of the main body 21 from undue abrasion and wear.

In FIG. 1, the flow restrictors 25 are each arranged to provide optimum fluid flow restriction therethrough while also providing relatively low fluid output velocity therefrom into the flow slots 27 and onto the face 23. In the present embodiment, each of the flow restrictors 25 comprise a plurality of commercially available wear resistant nozzles 37 having an o.d. corresponding to the size of the ports 24 so that each port 24 contains a first or uppermost nozzle, one or more intermediate nozzles, and an outlet or lowermost nozzle. In the present embodiment, the first nozzle in each port 24 is inverted or otherwise shaped to provide diffused fluid flow and has its orifice 41 sized to provide optimum fluid flow restriction. The intermediate nozzles located in each port 24 are also inverted or otherwise shaped to provide diffused fluid flow, but have their orifices sized to provide relatively low fluid flow restriction. The outlet nozzle in each port 24 is non-inverted or otherwise shaped to provide straightened fluid flow, and its orifice 42 is sized to provide relatively low fluid output velocity. All the nozzles 37 are sealed to the walls of the ports 24 by o-rings 38. Different quantities, shapes, and sizes of nozzles 37 may be installed in the ports 24 depending upon the kind and degree of fluid control desired. Also, the restrictors 25 may be of one piece, multistage construction rather than of a plurality of series connected individual nozzles. The restrictors 25 are thus arranged to provide both a means for developing a desired fluid pressure drop and a means for reducing the resultant fluid escape velocity.

In FIGS. 2 and 6-14, a fluid flow isolating ridge 39 extends from one side of the face 23 along the trailing edge of the cutters 1-18 on the first side of the face 23, across the center of the face 23, then along the trailing edge of the cutters 1-18 on the second side to the opposite side of the face 23. The ridge 39 is affixed or made integrally respective to the face 23 and is the minimum thickness for achieving the necessary required strength. The height of the flow isolating ridge 39 beyond the face 23 is equal to the height of the cutters 1-18 so that the ridge 39 contacts the bottom of the borehole during the drilling operation.

In FIGS. 2, 6-8, and 14, a plurality of fluid flow isolating ribs 40 extend concentrically along the face 23 from the trailing side of the ridge 39 along paths concentric with the main body 21 to the leading edges of the corresponding slots 27. The ribs 40 are solidly attached to the ridge 39 and to the face 23 and are the minimum thickness considered necessary for the required strength. The height of the ribs 40 beyond the face 23 is equal to the height of the cutters 1-18 and to the height of the ridge 39 so that the ribs 40 similarly contact the bottom of the borehole during the drilling operation. The ribs 40 are symmetrically located on the face 23 spaced radially from the center of the face 23 the maximum distance that provides adequate fluid flow isolation. The ridge 39 and the ribs 40 are of a material, such a steel, that can be worn away readily by rubbing against the bottom of a borehole while making hole.

As seen in FIGS. 1 and 3, parallel wrench flats 53 are machined onto opposite sides of the neck portion of the main body 21 in the conventional fashion to accommodate conventional tools for attaching or detaching the bit 110 to a drill pipe 62.

Figure 15:
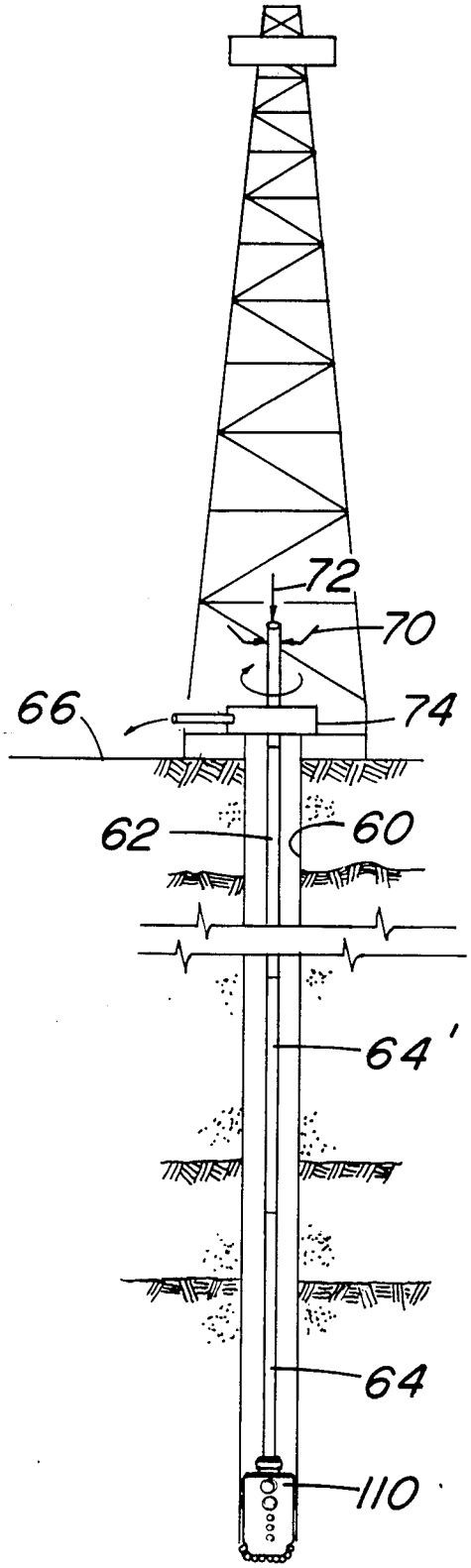

In FIG. 15, a borehole 60 has a drill string 62 and drill collar 64 therein with the bit 110 attached to the lower end thereof. A drilling rig 70 manipulates the drill string 62. Drilling fluid flows at 72 into the string and is returned through a rotating blowout preventor 74 in the usual manner.

In operation, the upper threaded end of the main body 21 is attached in the conventional manner to the lower end of a drill pipe, or drill string 62 and is then inserted in a borehole 60 and rotated in the conventional manner. The bit is forced downward against the bottom of the borehole by weight applied to the drill string in the conventional manner. As the invention is continuously rotated with weight applied, the ridge 39, the ribs 40, and the cutters 1-18 are all rubbed against the bottom of the borehole. The ridge 39 and the ribs 40 are reduced in height due to wear against the bottom of the borehole; however, the edges of the cutters 1-18 wear only slightly due to their material of construction. Thus, the cutters 1-18 penetrate the bottom of the borehole and remove material therefrom as the bit is rotated with weight applied. The action of the cutters 1-18, moves the cuttings from in front of the cutters 1-18 into the slots 27. The gauge cutters 52 remove material from the wall of the borehole and there by achieve the desired diameter of the bore hole. Conventional drilling fluid, supplied in the conventional manner from a suitable pump, is continuously pumped downward at 72, through the drill string 62, through the throat 22 of the present invention, through the flow restrictors 25, through the flow slots 27, then back up the bore hole annulus located outside of the drill string. The cut material is carried along by the flowing drilling fluid and is thus removed at 74 from the borehole.

Since the pressure drop across an orifice varies approximately as the square of the change in flow rate of a fluid flowing through the orifice, then the resultant fluid volume flowing through both orifices 41 (i.e. both restrictors 25) of the present invention will remain practically equal or balanced when appropriate total fluid volume and pressure is maintained. The orifices 41 can be sized to provide a predetermined or desired pressure drop for any given fluid flow rate. At any given fluid flow rate, the greater the pressure drop the more firmly equalized or balanced the flow through the restrictors 25 becomes. Also, each corresponding port 24, flow restrictor 25, and flow slot 27 forms and provides an isolated fluid path because the ridge 39 and the ribs 40 all contact the bottom of the borehole and thus prevent drilling fluid flowing in one slot 27 from escaping that slot except at the upper end of that slot. The flow of drilling fluid through either of the slots 27 will not become overbalanced or diverted and will therefore continue to flow adequately through each slot 27 and thereby force out the cut material even if packing or clogging tends to occur. Accordingly, balling or plugging is effectively avoided on the face 23 of the present bit.

Due to the configuration and arrangement of the flow restrictors 25, the velocity of the flowing drilling fluid as it leaves the restrictors 25 and enters the slots 27 is kept low enough so that no appreciable fluid erosion occurs on any part of the present bit even when a relatively high fluid flow rate and resultant pressure drop is maintained.

Drilling fluid flowing through the present bit is at a relatively elevated pressure within the throat 22 because of the pressure drop measured across the restrictors 25. Therefore, an outward force is exerted on the smaller end of the pistons 29, forcing the outer ends of the pistons 29 to move outward to any one of a range of extended positions and into relatively light contact with the wall of the borehole. Also, the blocking valves 45 are forced outward so that the outer ends of the valves 45 are seated in sealed relationship against the valve seat end of the sleeves 50, blocking any fluid flow therethrough. As the pistons 29 move outward, the chambers 32 expand in volume, causing a pressure differential which forces the hydraulic fluid from the reservoir 51, through the check valves 34, through the passages 35 and into the chambers 32. The caps 43 move inward to accommodate the reduced volume within the reservoirs 51. The check valves 34 prevent any reverse flow of hydraulic fluid and thus provides a hydraulic barrier within the chambers 32 so that the pistons 29 cannot move inward from any extended position, even when an extreme opposite force is exerted inwardly on the pistons 29 from the wall of the borehole. In like manner, as the outer ends of the pistons 29 slowly wear due to friction against the wall of the borehole, the pistons 29 continually move slowly outward and more hydraulic fluid is drawn into and retained within the chambers 32. Thus, means are provided by which the pistons 29 are continually compensated for wear and remain in constant contact with the wall of the borehole. Accordingly, the present invention provides means by which a drill bit is prevented from whipping or radially vibrating. During this time, the cutters 1–18 and the gauge cutters 52 are positioned where they are protected from impact damage and from the premature failure which may otherwise result therefrom.

Reduced circulation of drilling fluid reduces the pressure drop across the restrictors 25, and the fluid pressure within the throat 22 is therefore reduced until it becomes equalized with respect to the fluid pressure on the outside of the main body 21. Thus, in this condition, no outward force is exerted against the pistons 29 or the blocking valves 45. Hence, the outer ends of the blocking valves 45 are no longer sealed against the valve seat ends of the sleeves 50 and fluid is therefore allowed to flow therethrough. Thus, in this condition, when an inward force is exerted on the outer ends of the pistons 29, hydraulic fluid flows freely out of the chambers 32, through the passages 35, against the outer ends of the blocking valves 45, forcing the blocking valves inward away from the valve seat of the sleeves 50, so the fluid flows through the sleeves 50 past the shanks 44, and into the reservoirs 51. At this time, the caps 43 can move outward to accommodate the added fluid volume within the reservoirs 51. Therefore, the pistons 29 can be selectively allowed to retract inward by removing fluid pressure within the throat 22.

The main body 21 and the holes and passages therein, the pistons 29, blocking valves 45, sleeves 50, and the caps 43 with shanks 44 all can be readily fabricated by convenional methods, such as machining or molding. The cutters 1–18, o-rings 31, wear resistant buttons 36, nozzles 37, o-rings 38, and the gauge cutters 52 are all readily available commercial products which can be installed in the bit of the present invention. Various different check valves 34 of conventional design may be either built into the present bit or purchased separately and assembled thereinto. Thus, the present invention can be readily and economically manufactured.

Having thus described the invention, it is to be understood that certain modifications in the construction and arrangement of the parts thereof may be made, as deemed necessary, without departing from the scope of the appended claims.

I claim:

1. A stabilized drill bit comprising: a generally cylindrical main body having means at an upper end thereof for attachment to a driving means; a drilling face at the lower end of said main body; drilling cutters secured to said face; a throat formed through said main body for passage of drilling fluid to said face; flow restricting means positioned in the fluid path of the bit with said flow restricting means arranged to provide a fluid pressure drop therethrough; radially active stabilizing means for radially stabilizing said main body; means responsive to fluid pressure in said bit for applying outward force on said radially active stabilizing means and thereby moving said radially active stabilizing means into any one of a range of different extended positions; and blocking means for selectively preventing inward radial movement of said radially active stabilizing means from any of said extended positions upon application of radial force upon said main body opposed to said radially active stabilizing means sufficient to displace said fluid pressure in said bit.

2. A stabilized drill bit as in claim 1 wherein each of the said flow restricting means includes: a first nozzle stage shaped, sized, and arranged to provide a combination of desired fluid flow restriction and diffused fluid flow; an intermediate nozzle stage shaped, sized, and arranged to provide a combination of minimal fluid flow restriction and diffused fluid flow; and a final outlet nozzle stage shaped, sized, and arranged to provide a combination of minimal fluid flow restriction and straightened fluid flow.

3. A stabilized drill bit as in claim 1 wherein flow from said flow restricting means occurs onto said face and along distinct isolated flow paths; said isolated flow paths include ridges secured to said face and of sufficient height to contact the bottom of a borehole during normal operation, said ridges extend across said face and effectively barricade both sides of each said isolated flow path.

4. A stabilized drill bit as in claim 1 wherein said radially active stabilizing means includes a differential diameter piston installed in said main body and arranged to be forced radially outward by fluid pressure from said throat acting on the smaller end of said differential diameter piston, with inward radial movement of said differential diameter piston being prevented by a hydraulic barrier formed between the smaller and larger ends of said differential diameter piston.

5. A stabilized drill bit as in claim 4 wherein said blocking means includes a check valve in combination with a blocking valve, said blocking valve being arranged to be closed by fluid pressure effected thereon and opened by removal of the fluid pressure thereon, and thereby, in combination with said check valve, to selectively retain or release said hydraulic barrier formed between the smaller and larger ends of said differential diameter piston.

6. A stabilized drill bit as in claim 1 wherein an incompressible hydraulic fluid is contained and utilized within said blocking means and is sealably contained within one or more variable volume reservoirs corresponding to said radially active stabilizing means, said variable volume reservoirs being arranged separate from contaminants without.

7. A stabilized drill bit as in claim 1 wherein said flow restricting means include means for reducing the resultant fluid escape velocity therethrough.

8. A stabilized drill bit comprising; a main body having means at an upper end thereof for attachment to a driving means; means forming a drilling face at the lower end of said main body, drilling cutters secured to said face; a throat formed through said main body for passage of drilling fluid to said face; flow restricting means positioned within said throat by which the fluid pressure in said throat provides a desired pressure drop therethrough while simultaneously providing fluid pressure onto said face; radial stabilizing means for radially stabilizing said main body, including at least one radially acting member arranged within said main body for outward radial movement thereof and to transmit an outward radial force against the wall of the borehole while resisting inward radial force with inward movement thereof blocked; means responsive to fluid pressure in said throat for applying outward radial force upon said radially acting member and thereby moving said radially acting member into any one of a range of different extended positions; and blocking means for blocking inward radial movement of the said radially action member in any of said extended positions when radial force sufficient to displace said fluid pressure in said throat acts upon the said main body in opposition to said radial stabilizing means.

9. The bit of claim 8 wherein said main body includes a radial bore, said radial stabilizing means includes a differential diameter piston reciprocatingly received within said bore and arranged to be forced radially outward by fluid pressure acting on the smaller end of said differential diameter piston, with inward radial movement of said differential diameter piston being prevented by said blocking means which includes a hydraulic barrier formed between the smaller and larger ends of said differential diameter pistion.

10. The bit of claim 9 wherein the said blocking means includes a check valve in combination with a blocking valve, said blocking valve is arranged to be closed by fluid pressure thereon and opened by removal of fluid pressure thereon, and thereby, in combination with said check valve, to selectively retain or release said hydraulic barrier formed between the smaller and larger ends of said differential diameter piston.

11. The bit of claim: 10 wherein an incompressible hydraulic fluid is contained and utilized within said blocking means and is sealably contained within one or more variable volume reservoirs corresponding to said radially active stabilizing means, said variable volume reservoirs arranged to keep said incompressible hydraulic fluid within said reservoirs separate from contaminants without.

12. A stabilized drill bit comprising a generally cylindrical main body having an upper end opposed to a lower end, means at said upper end by which a drill bit can be attached to a driving means, means forming a drilling face at said lower end, said drilling face includes cutters thereon for penetrating geological formations when the drill is making hole;

a throat formed longitudinally through said main body for passage of drilling fluid from said driving means to said drilling face;

means forming a plurality of stabilizing members arranged circumferentially about the throat and within said main body, said stabilizing members have a formation engaging face at the outer end thereof which can be retracted towards said main body and extended outwardly past the peripheral surface of the main body and into engagement with a borehole wall to thereby stabilize the bit;

hydraulic responsive means by which each of said stabilizing members are forced to move in a direction outwardly of said main body to any one of a range of different extended positions when the hydrostatic pressure within said throat is greater than the hydrostatic pressure at the face of the said stabilizing members, and blocking means which maintains the said stabilizing members extended in any one of the said extended positions in the event sufficient radial force to displace said hydrostatic pressure in said throat acts upon the said bit opposed to said stabilizing members.

13. The stabilized drill bit of claim 12 wherein said hydraulic responsive means allows the stabilizing members to retract when the said hydrostatic pressure differential is reversed or removed.

14. The stabilized bit of claim 12 wherein each of the said flow restricting means includes; a first nozzle stage shaped, sized, and arranged to provide a combination of desired fliud flow restriction and diffused fluid flow; in intermediate nozzle stage shaped, sized, and arranged to provide a combination of minimal fluid restriction and diffused fluid flow; and a final outlet nozzle stage shaped, sized, and arranged to provide a combination of minimal fluid flow restriction and straightened fluid flow.

15. The stabilized bit of claim 12 wherein the said flow isolating means include ridges secured to said face and of sufficient height to contact the bottom of a borehole during normal operation, said ridges extend across the said face to effectively barricade both sides of each desired fluid flow path.

16. The stabilized bit of claim 12 wherein said stabilizing member is in the form of a piston having opposed ends of different diameters; said blocking means includes a check valve in combination with a blocking valve; said blocking valve is arranged to be closed by fluid pressure thereon and opened by removal of fluid pressure thereon, and thereby, in combination with said check valves, to selectively retain or release a hydraulic barrier formed between the smaller and larger ends of said piston.

17. The stabilized bit of claim 12 wherein said stabilizing members includes a differential diameter piston installed in said main body and arranged to be forced radially outward by fluid pressure acting on the smaller end of said differential diameter piston with inward radial movement of said differential diameter piston being prevented by a hydraulic barrier formed between the smaller and larger ends of the said differential diameter piston.

18. The stabilized bit of claim 12 wherein an incompressible hydraulic fluid is contained and utilized within said blocking means and is sealably contained within one or more variable volume reservoirs corresponding to said radially active stabilizing means, said variable volume reservoirs arranged to keep said incompressible hydraulic fluid within said reservoirs separate from contaminants without.

* * * * *